US007605547B2

(12) United States Patent
Ng

(10) Patent No.: US 7,605,547 B2
(45) Date of Patent: Oct. 20, 2009

(54) ADDRESSABLE LED ARCHITECTURE

(75) Inventor: Chee Yu Ng, Singapore (SG)

(73) Assignee: STMicroelectronics Asia Pacific PTE Ltd., Singapore (SG)

( * ) Notice: Subject to any disclaimer, the term of this patent is extended or adjusted under 35 U.S.C. 154(b) by 0 days.

(21) Appl. No.: 11/881,399

(22) Filed: Jul. 26, 2007

(65) Prior Publication Data

US 2008/0088258 A1 Apr. 17, 2008

(30) Foreign Application Priority Data

Jul. 28, 2006 (SG) ..... 200605101

(51) Int. Cl.
*G05F 1/00* (2006.01)

(52) U.S. Cl. ..... 315/294; 315/295; 315/297; 315/312; 315/291; 315/317; 315/185 R

(58) Field of Classification Search ..... 315/185 R, 315/291, 294, 295, 297, 307, 312, 317, 318; 345/46, 82–84, 92, 204
See application file for complete search history.

(56) References Cited

U.S. PATENT DOCUMENTS 6,144,222 A * 11/2000 Ho ..... 326/82
6,777,891 B2 * 8/2004 Lys et al. ..... 315/291
7,394,444 B2 * 7/2008 Kim et al. ..... 345/87

* cited by examiner

*Primary Examiner*—Haissa Philogene
(74) *Attorney, Agent, or Firm*—Lisa K. Jorgenson; William A. Munck

(57) ABSTRACT

The present disclosure provides an addressable light emitting diodes (LED) architecture that is able to control a plurality of LEDs individually. The present disclosure further provides a method of controlling the operation of at least one chain of serially connected LEDs.

20 Claims, 3 Drawing Sheets

ADDRESSABLE LED ARCHITECTURE

CROSS-REFERENCE TO RELATED APPLICATIONS

The present application is related to Singapore Patent Application No. 200605101-5, filed Jul. 28, 2006, entitled "ADDRESSABLE LED ARCHITECTURE". Singapore Patent Application No. 200605101-5 is assigned to the assignee of the present application and is hereby incorporated by reference into the present disclosure as if fully set forth herein. The present application hereby claims priority under 35 U.S.C. §119(a) to Singapore Patent Application No. 200605101-5.

TECHNICAL FIELD

The present disclosure generally relates to light emitting diodes (LED), and more particularly to a LED architectures that enable serially connected LEDs to be controlled individually.

BACKGROUND

Light emitting diodes (LEDs) generally offer several advantages over conventional light sources. For example, LEDs are small in size, are able to produce more colors and provide versatility in a broad range of applications. Some of these applications include traffic indicators, automotive lightings and light display devices.

A conventional LED light system or architecture includes an array of LEDs coupled to a plurality of LED drivers. The LED driver is one of the important components of a LED lighting system and serves as the power supply for the LED lighting system. In particular, the LED driver typically converts a higher input AC power to the proper low-voltage DC power required by the LEDs. Also, voltage fluctuations may cause the LEDs to change their light output. The LED driver prevents the voltage fluctuations by regulating the current flowing through the LEDs.

The LED light system can be designed in a variety of configurations. One conventional basic configuration includes a LED driver coupled to a chain of serially connected LEDs. In particular, the LED driver generates a pulse-modulated current to control the brightness of the serially connected LEDs. However, this configuration does not enable the LED driver to control the brightness of each individual LED. In order to control the brightness of each LED individually, a multiple channel LED driver is typically used in the system.

There is therefore a need for improved systems and methods to control a large number of LEDs individually.

SUMMARY

Among other things, embodiments of the present disclosure generally provide an LED light system that includes single channel drivers that drive a plurality of serially connected LEDs. The brightness of each LED is accordingly individually controllable.

In one embodiment, the present disclosure provides a light emitting diode (LED) architecture. The LED architecture includes a plurality of chain controllers configured to generate predetermined drive currents where the predetermined drive currents include switching signals. The LED architecture also includes a plurality of LED devices that are serially connected to form a plurality of chains of LED devices. Each chain of LED devices is coupled to one of the plurality of chain controllers. Each LED device includes at least one LED and an LED controller coupled to the LED. The LED controller is configured to receive the switching signals for controlling the operation of the LED. The plurality of chain controllers generates predetermined drive currents to control the operation of each LED controller in each chain of LED devices, thereby controlling the operation of each LED individually in the each chain of LED devices.

In another embodiment, the present disclosure provides a method of controlling the operation of at least one chain of serially connected light emitting diodes (LEDs). The method includes generating predetermined drive currents by a chain controller. The chain controller is coupled to the at least one chain of serially connected LEDs. The predetermined drive currents include switching signals. The method also includes receiving switching signals by a plurality of LED controllers, wherein each of the plurality of LED controllers is coupled to one of the serially connected LEDs. The plurality of LED controllers control the operation of the serially connected LEDs in response to the switching signals, thereby controlling the operation of the serially connected LEDs individually.

In still another embodiment, the present disclosure provides an addressable light emitting diode (LED) architecture. The addressable LED architecture includes a plurality of chain controllers configured to generate predetermined drive currents, where the predetermined drive currents include switching signals. The addressable LED architecture also includes a plurality of LED devices. The plurality of LED devices is serially connected to form a plurality of chains of LED devices. Each chain of LED devices is coupled to one of the plurality of chain controllers. Each LED device includes at least one LED and a LED controller coupled to the LED. The LED controller is configured to receive the switching signals for controlling the operation of the LED. The plurality of chain controllers generate predetermined drive currents to control the operation of each LED controller in each chain of LED devices, thereby controlling the operation of each LED individually in the each chain of LED devices. The addressable LED architecture also includes a master controller coupled to the plurality of chain controllers to control the operation of the plurality of chain controllers.

Other technical features may be readily apparent to one skilled in the art from the following figures, descriptions and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

Figure 1:
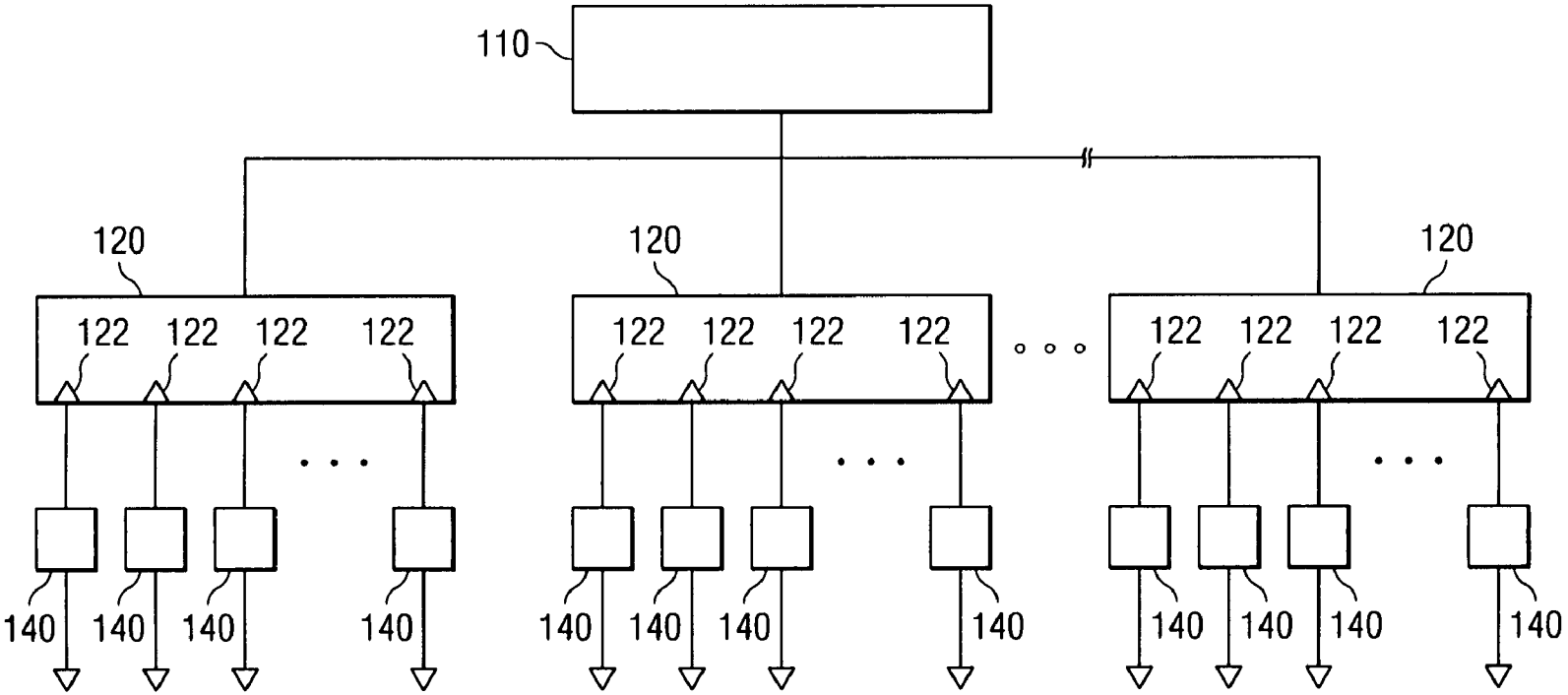
FIG. 1 (PRIOR ART)
FIG. 1 illustrates an example block diagram of a conventional LED system including multiple channel LED drivers.

FIG. 1 shows a conventional system that includes a master controller 110 coupled to a plurality of multiple channel LED drivers 120. Each multiple channel LED driver 120 is coupled to a plurality of LEDs 140. Specifically, each channel 122 of the multiple channel LED driver 120 is coupled to one LED 140. Although the multiple channel LED driver 120 is able to control the brightness of each LED 140 individually, it has certain limitations. For example, each channel 122 is only able to drive one LED 140. Also, every LED 140 is coupled to the multiple channel LED driver 120, resulting in a complicated PCB layout. Furthermore, the number of LEDs 140 is limited by the number of channels 122 available on the multiple channel LED driver 120.

Embodiments of the present disclosure generally provide an addressable LED architecture to control a plurality of LEDs individually. The LED architecture can be implemented in applications such as large display screens, or display features in personal digital assistants, cell phones, digital still cameras, and camcorders. It should be understood, however, that embodiments of the present disclosure are not limited to the above examples but could also include other applications such as lighting systems.

In one embodiment, the present disclosure provides a method of controlling the operation of chains of serially connected LEDs. The method includes generating predetermined drive currents by a chain controller. The chain controller is coupled to the at least one chain of serially connected LEDs. The predetermined drive currents include switching signals and receiving switching signals by a plurality of LED controllers. Each of the plurality of LED controllers is coupled to one of the serially connected LEDs. The plurality of LED controllers control the operation of the serially connected LEDs in response to the switching signals, thereby controlling the operation of the serially connected LEDs individually.

Figure 2:
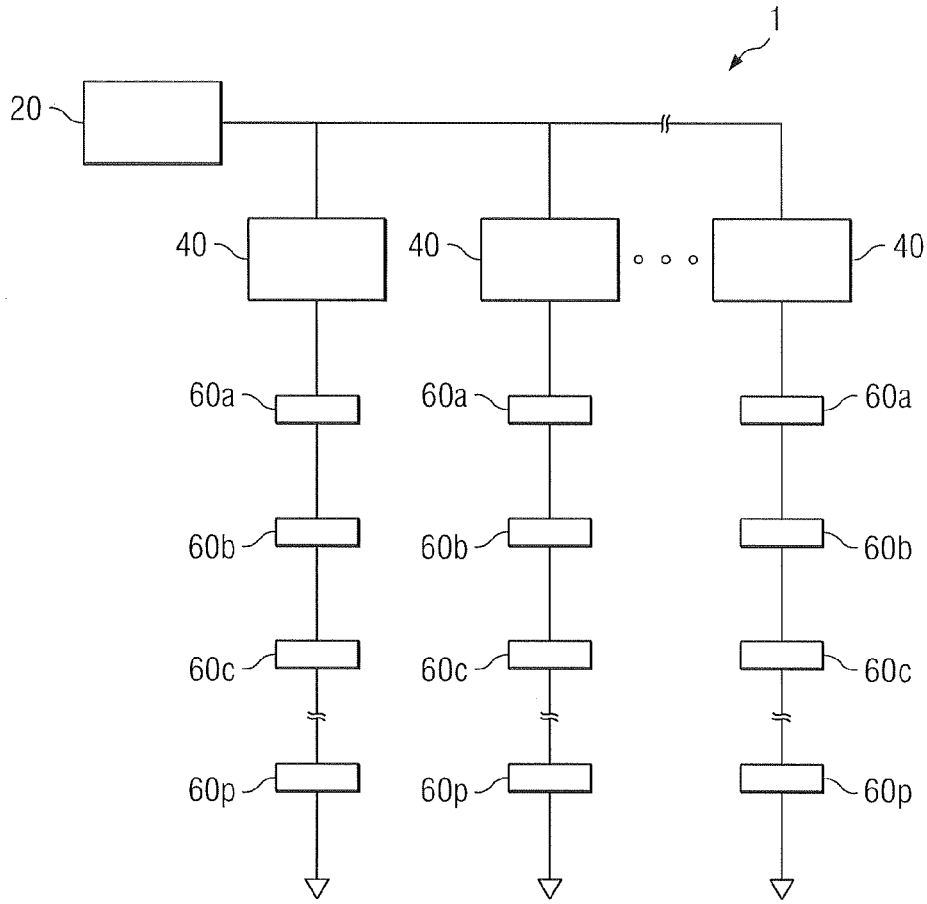
FIG. 2 is a somewhat simplified block diagram of an example addressable LED architecture in accordance with one embodiment of the present disclosure.

FIG. 2 is a somewhat simplified block diagram of an exemplary LED architecture 1 according to one embodiment of the present disclosure. LED architecture 1 includes a master controller 20, a plurality of chain controllers 40, and a plurality of LED devices generally represented by the numeral 60. The master controller 20 can be any type of microcontroller unit, and is electrically coupled to the plurality of chain controllers 40. The electrical connections between the master controller 20 and the plurality of chain controllers 40 can be 12C, SPI or CAN. Furthermore, the master controller 20 and the plurality of chain controllers 40 receive electrical power from a power input terminal (not shown) for energizing their operations. The master controller 20 controls the operation of the plurality of chain controllers 40 in order to control the overall display and brightness of the LED architecture 1. The chain controller 40 can be a dedicated integrated chip (IC) with 6 to 8 pins.

Accordingly, in one aspect, the LED architecture includes a plurality of single channel drivers (referred hereinafter as chain controllers) configured to generate predetermined drive currents. The predetermined drive currents include switching signals. The LED architecture could also include plurality of LED devices. The plurality of LED devices are serially connected to form a plurality of chains of LED devices. Each chain of LED devices is coupled to one of the plurality of chain controllers and each LED device includes at least one LED and a LED controller coupled to the LED. The LED controller is configured to receive the switching signals for controlling the operation of the LED. The plurality of chain controllers generate predetermined drive currents to control the operation of each LED controller in each chain of LED devices, thereby controlling the operation of each LED individually in the each chain of LED devices.

The plurality of chain controllers 40 are coupled to a plurality of LED devices 60. In particular, each chain controller 40 is coupled to a chain of serially connected LED devices 60, also known as a daisy chain configuration. The advantage of implementing a daisy chain configuration is that there is no direct connection from each LED device 60 to the respective chain controller 40, and thus the daisy chain configuration provides simple connections and allows easy PCB layouts.

Furthermore, the chain of LED devices 60 can be cascaded in the LED architecture 1, thus enabling a large number of LED devices 60 to be controlled by a single master controller 20. Each chain controller 40 is electrically coupled to a chain of LED devices 60 via a power line (not shown). Furthermore, the plurality of chain controllers 40 also control the operation of corresponding LED devices 60 via the power line. Depending on the type of signals received from the master controller 20, each of the chain controllers 40 would generate drive currents to control their corresponding chain of LED devices 60. The method of generating drive currents to control the chains of LED devices 60 is discussed in detail herein below.

Figure 3:
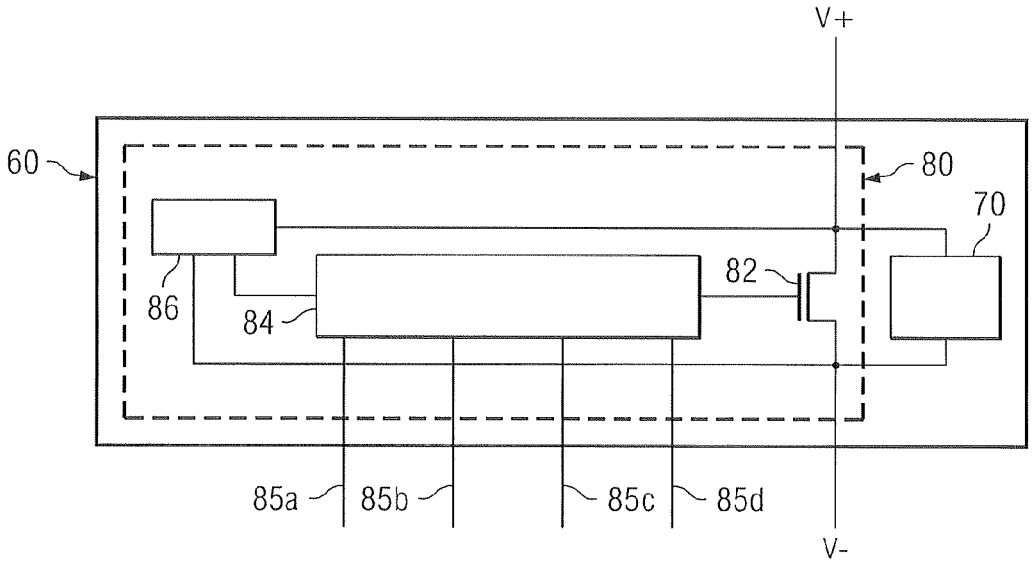
FIG. 3 is a somewhat simplified block diagram of an example LED device in accordance with one embodiment of the present disclosure.

FIG. 3 is a somewhat simplified block diagram of an example LED device 60 according to one embodiment of the present disclosure. The LED device 60 includes a LED 70 coupled to a LED controller 80. The LED controller 80 can be an integrated component of the LED device 60. Alternatively, the LED device 60 and the LED controller 80 can be separate components where the LED controller 80 can be a dedicated 2 or 6 pins IC electrically coupled to the LED device 60, particularly to the LED 70. The LED controller 80 is configured to receive the drive currents generated from the corresponding chain controller 40, and the LED controller 80 controls the operation of the LED 70 in response to the drive current.

The anode terminal of the LED 70 is coupled to a V+ node, and the cathode terminal coupled to a V− node. Furthermore, the LEDs 70 in a single chain of LED devices 60 can be of the same color, for example red, green, yellow or white. Alternatively, a single chain of LED devices 60 may include a combination of different colors of LEDs 70. Different colors or types of LEDs have different operating characteristics, which is difficult to control if they are combined in a single chain. However, in one embodiment, the operation of each LED 70 is controlled by the LED controller 80, thus different colors or types of LED can be serially connected in a single chain of LED devices 60, thereby enhancing the versatility of the LED architecture 1.

The LED controller 80 includes a switch 82, a switch controller 84, and a charge pump 86. The switch 82 is coupled to the LED 70. The switch 82 is preferably a normally-off NMOS transistor. However, other types of transistors may also be used according to embodiments of the present disclosure. The switch 82 is referred hereinafter as the NMOS. The gate terminal of the NMOS 82 is coupled to the switch controller 84, the drain terminal coupled to the V+ node, and the source terminal coupled to the V− node. The switch controller 84 has a plurality of address terminals generally referenced by the numeral 85. The plurality of address terminals 85 are coupled to the V+ node or V− node. The address terminals 85 of switch controller 84 are uniquely coupled to the V+ and V− nodes for each of the plurality of LED devices 60, are discussed in detail herein below. The charge pump 86 is coupled to the V+ node and V− node. Furthermore, the charge pump 86 is coupled to the switch controller 84 for the purpose of maintaining the voltage supply to the switch controller 84.

In the daisy chain configuration, the chain controller 40 is coupled to the V+ node of a first LED device 60*a*. The V− node of the first LED device 60*a* is then coupled to the V+ node of a second LED device 60*b*. Similarly, the V− node of the second LED device 60*b* is coupled to the V+ node of a third LED device 60*c*. The V− node of the last LED device 60*p* in the chain is then coupled to a ground terminal.

The operation of the LED architecture 1 is generally discussed herein below. Basically, a LED has a forward voltage drop of up to 4.5 V in normal operating conditions. At a low current for example less than 5 mA, the brightness of the LED is insignificant. Thus, a small change in the current drive results in a significant change in the forward voltage drop of the LED. Typically, the change in the forward voltage drop is from 200 mV to 500 mV. In one embodiment, LED architecture 1 uses the range of forward voltage drop (200-500 mV) as a transmission medium for controlling the individual LEDs.

In operation, the master controller 20 transmits digital signals to the plurality of chain controllers 40. Each of the plurality of chain controllers 40 is pre-assigned with a unique identity. In response to the digital signals, the plurality of controllers 40 generate drive currents to control the chains of LED devices 60. Specifically, a particular chain controller 40 generates drive currents to control each individual LED 70 in the chain of LED devices 60. The chain controller 40 transmits a high drive current pulse to generate a high voltage drop across a LED 70, and transmit a low drive current pulse to generate a low voltage drop across the LED 70. For illustration purposes, the high drive current pulse is assigned at 5 mA and the low drive current pulse is assigned at 3 mA. It is contemplated that the high drive current pulse and low drive current pulse can be assigned with different current values and are not restricted to the above example.

Figure 4:
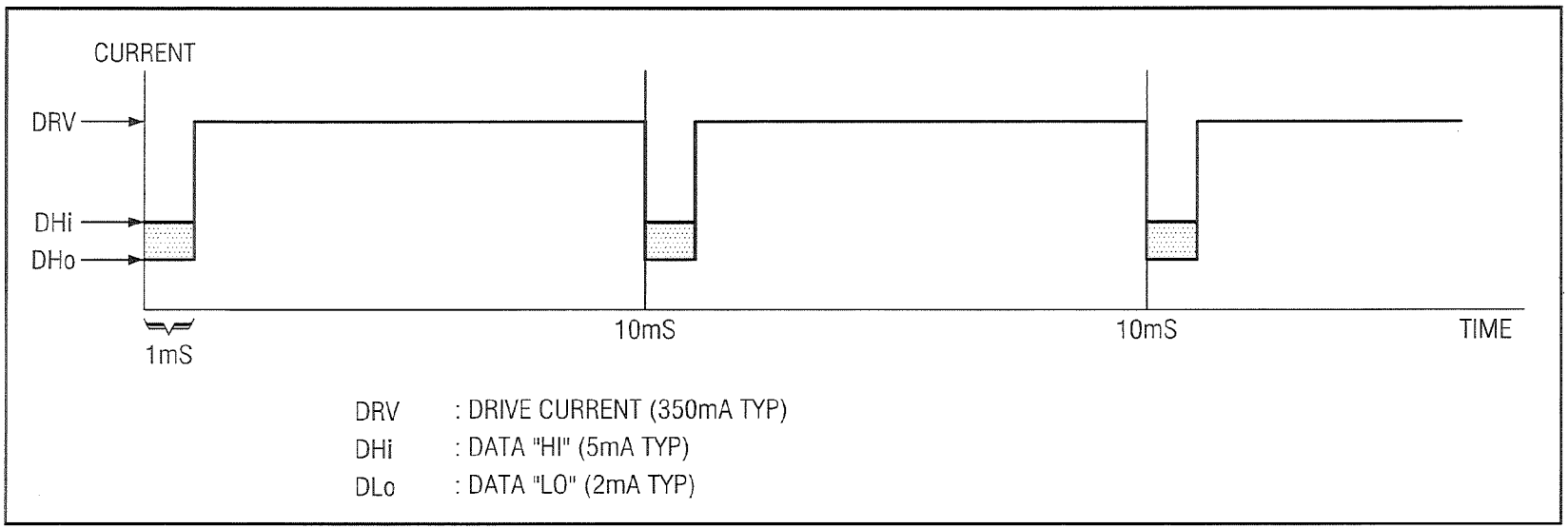
FIG. 4 illustrates an example drive current output from a chain controller in accordance with one embodiment of the present disclosure.

FIG. 4 illustrates an example drive current generated by the chain controller 40 according to one embodiment of the present disclosure. The drive current is driven in a plurality of frames. For example, each frame has a period of 10 ms, where the first 1 ms of the frame is assigned as the control header, and the remaining 9 ms of the frame is assigned as the bulk drive. It is should be understood that the frame, control header and bulk drive are not limited to the above example, and may be assigned with other values.

During the control header of the frame, the chain controller 40 generates a series of high drive current pulses (5 mA) and low drive current pulses (3 mA) to produce a series of voltage swings between 200 mV to 500 mV. The series of voltage swings serve as switching signals that control the operation of the chain of LED devices 60. Specifically, the switching signals comprise data bytes or a string of binary numbers (e.g. 10110010 . . . ) for controlling the operation of the switch controllers 84 in the chain of LED devices 60. During the bulk drive, the chain controller 40 provides a constant drive current and no data is transmitted during this period.

In this embodiment, the switch controller 84 drives the NMOS 82 in response to the switching signals, thereby controlling the operation of the LED 70. For illustration purposes, the NMOS 82 can be driven in three operating modes as shown in Table 1 below:

TABLE 1

NMOS Operating Modes

| Operating Mode | NMOS (Vds represents the drain source voltage of NMOS 82) |
|---|---|
| Mode 1 | Data State (Vds = Vdata) |
| Mode 2 | Drive-Hi State (Vds = Vbright) |
| Mode 3 | Drive-Low State (Vds = Vdark) |

Furthermore, the voltage levels are predetermined as shown in Table 2 below:

TABLE 2

NMOS Voltage Levels

| Operating Mode | Voltage Levels |
|---|---|
| Mode 1 | Vbright = 3.5 V-4.5 V |
| Mode 2 | Vdark, Vdata_hi = 2.5 V |
| Mode 3 | Vdata, Vdata_low = 2.0 V |

During the Data State, the switch controller 84 drives the NMOS 82 to Vdata. However, due to the slow response of the NMOS 82 at the Data State, the Vds swings between Vdata_low and Vdatahi.

As discussed above, each switch controller 84 has a plurality of address terminals 85. The address terminals 85 are uniquely coupled to the V+ and V− nodes for every switch controller 84 in a particular chain of LED devices 60. For example, in the first LED device 60*a*, address terminal 85*a* can be coupled to the V+ node, and address terminals 85*b*, 85*c*, 85*d* can be coupled to the V− node. In the second LED device 60*b*, address terminals 85*a*, 85*b* can be coupled to the V+ node, and address terminals 85*c*, 85*d* can be coupled to the V− node. By varying the switching signals of the drive current, the chain controller 40 is able to control the switch controllers 84 in the chain of LED devices 60, and thus allowing each LED 70 to be controlled individually. Specifically, the switch controller 84 controls the NMOS 82 in response to the switching signals. Suppose NMOS 82 is open, it permits electrical current to flow through the LED 70 where the LED 70 is turned on. When NMOS 82 is closed, it becomes a short circuit and thereby shunts current around the LED 70 where the LED 70 is now turned off.

As discussed above, the chain controller 40 generates drive currents to control the LEDs 70 individually. For example in a first 10 ms frame, the chain controller 40 generates drive current pulses including switching signals to turn on or turn off the desired LEDs 70 in the chain of LED devices 60. In the second 10 ms frame, the desired LEDs 70 are either turned on or off. Also, the drive current pulses generated in the second 10 ms frame will determine whether the LEDs 70 remain on or off in the following third frame. Hence, each of the LEDs 70 is either turned on or off for each particular frame. Due to the fact that the 10 ms frames are occurring very fast, the human naked eye does not visualize the actual turning on/off of the LEDs 70 but sees the variation in brightness of the LEDs 70.

It should be understood that other embodiments of the present disclosure could be apparent. For example, in other embodiments according the present disclosure a single chain of LED devices 60 may include a combination of different colors of LEDs 70 instead of a single color. Furthermore, other types of transistors such as bipolar junction transistors (BJT) or complementary MOSFETS (CMOS) can be used as the switch 82. Also, each frame of the drive current may include more than one control header. For example, one frame can be equally divided into two periods where each period includes the control header and the bulk drive.

It may be advantageous to set forth definitions of certain words and phrases used in this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A light emitting diode (LED) architecture comprising:

a plurality of chain controllers configured to generate predetermined drive currents, wherein the predetermined drive currents include switching signals;

a plurality of LED devices, wherein the plurality of LED devices are serially connected to form a plurality of chains of LED devices, wherein each chain of LED devices is coupled to one of the plurality of chain controllers, wherein each LED device comprises:

at least one LED; and a LED controller coupled to the LED, wherein the LED controller is configured to receive the switching signals for controlling the operation of the LED, wherein the plurality of chain controllers generate predetermined drive currents to control the operation of each LED controller in each chain of LED devices, thereby controlling the operation of each LED individually in the each chain of LED devices.

2. The LED architecture of claim 1, wherein the LED controller comprises:

a switch coupled to the LED; and a switch controller coupled to the switch, wherein the switch controller opens or closes the switch in response to the switching signals, and wherein the switch when opened allows electrical current to flow through the LED, wherein the switch when closed shunts electrical current around the LED.

3. The LED architecture of claim 2, wherein each LED device further comprises a charge pump for maintaining the voltage supply to the switch controller.

4. The LED architecture of claim 2, wherein the switch is a NMOS transistor.

5. The LED architecture of claim 1, wherein the plurality of chain controllers can be dedicated integrated chips.

6. The LED architecture of claim 1, wherein the LED controller can be a dedicated integrated chip.

7. The LED architecture of claim 1, further comprising a master controller coupled to the plurality of chain controllers, wherein the master controller controls the operation of the plurality of chain controllers.

8. The LED architecture of claim 7, wherein the master controller can be coupled to the plurality of chain controllers via 12C, SN or CAN connections.

9. The LED architecture of claim 7, wherein the master controller can be a microcontroller unit.

10. The LED architecture of claim 1, wherein each chain of LED devices may comprise different colors or types of LEDs.

11. The LED architecture of claim 1, wherein the LED device is selected from the group consisting of large display screens, or display means in personal digital assistants, cell phones, digital still cameras, and camcorders.

12. A method of controlling the operation of at least one chain of serially connected light emitting diodes (LEDs), the method comprising:

generating predetermined drive currents by a chain controller, wherein the chain controller is coupled to the at least one chain of serially connected LEDs, wherein the predetermined drive currents include switching signals;

receiving switching signals by a plurality of LED controllers, wherein each of the plurality of LED controllers is coupled to one of the serially connected LEDs, and wherein the plurality of LED controllers control the operation of the serially connected LEDs in response to the switching signals, thereby controlling the operation of the serially connected LEDs individually.

13. The method of claim 12, further comprising:

transmitting digital signals by a master controller, wherein the master controller is coupled to the chain controller, wherein the master controller controls the predetermined drive currents generated by the chain controller.

14. The method of claim 13, wherein the master controller can be coupled to each chain controller via 12C, SPI or CAN connections.

15. The method of claim 12, wherein each of the plurality of LED controllers comprises:

a switch coupled to the LED; and a switch controller coupled to the switch, wherein the switch controller opens or closes the switch in response to the switching signals, wherein the switch when opened allows electrical current to flow through the LED, wherein the switch when closed shunts electrical current around the LED.

16. The method of claim 12, wherein the at least one chain of serially connected LEDs may comprise different colors or types of LEDs.

17. An addressable light emitting diode (LED) architecture comprising:

a plurality of chain controllers configured to generate predetermined drive currents, wherein the predetermined drive currents include switching signals;

a plurality of LED devices, wherein the plurality of LED devices are serially connected to form a plurality of chains of LED devices, wherein each chain of LED devices is coupled to one of the plurality of chain controllers, wherein each LED device comprises:

at least one LED; and a LED controller coupled to the LED, wherein the LED controller is configured to receive the switching signals for controlling the operation of the LED, wherein the plurality of chain controllers generate predetermined drive currents to control the operation of each LED controller in each chain of LED devices, thereby controlling the operation of each LED individually in the each chain of LED devices; and a master controller coupled to the plurality of chain controllers to control the operation of the plurality of chain controllers.

18. The addressable LED architecture of claim 17, wherein the LED controller comprises:

a switch coupled to the LED; and a switch controller coupled to the switch, wherein the switch controller opens or closes the switch in response to the switching signals, and wherein the switch when opened allows electrical current to flow through the LED, wherein the switch when closed shunts electrical current around the LED.

19. The addressable LED architecture of claim 18, wherein each LED device further comprises a charge pump for maintaining the voltage supply to the switch controller.

20. The addressable LED architecture of claim 18, wherein the switch is a NMOS transistor.

* * * * *